US009705186B1

(12) United States Patent
Lozada-Ortiz et al.

(10) Patent No.: US 9,705,186 B1
(45) Date of Patent: Jul. 11, 2017

(54) SCALABLE VERTICAL BUOYANT CABLE ANTENNA

(71) Applicants: Pablo Lozada-Ortiz, Portsmouth, RI (US); Isaac A Wheeler, Coventry, RI (US)

(72) Inventors: Pablo Lozada-Ortiz, Portsmouth, RI (US); Isaac A Wheeler, Coventry, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 183 days.

(21) Appl. No.: 14/684,487

(22) Filed: Apr. 13, 2015

(51) Int. Cl.

| | |
|---|---|
| ***H01Q 1/34*** | (2006.01) |
| ***H01Q 1/50*** | (2006.01) |
| ***H01Q 1/04*** | (2006.01) |
| *H01Q 13/10* | (2006.01) |
| *H01Q 7/08* | (2006.01) |
| *H01Q 1/16* | (2006.01) |

(52) U.S. Cl.
CPC ..... *H01Q 1/34* (2013.01); *H01Q 1/04* (2013.01); *H01Q 1/50* (2013.01); *H01Q 1/16* (2013.01); *H01Q 7/08* (2013.01); *H01Q 13/10* (2013.01)

(58) Field of Classification Search
USPC ..... 343/709, 719
See application file for complete search history.

(56) References Cited

U.S. PATENT DOCUMENTS

| | | | | |
|---|---|---|---|---|
| 3,623,116 A * | 11/1971 | Green | H01Q 7/08 | 343/788 |
| 8,842,051 B1 * | 9/2014 | Mileski | H01Q 1/34 | 343/709 |
| 2011/0030477 A1 * | 2/2011 | Cousins | G01N 29/043 | 73/589 |

* cited by examiner

*Primary Examiner* — Jessica Han
*Assistant Examiner* — Hai Tran
(74) *Attorney, Agent, or Firm* — James M. Kasiachke; Michael P. Stanley; Jean-Paul A. Nasser

(57) ABSTRACT

The invention is a modular buoyant cable antenna that is towed on the surface of a body of water by a submerged underwater vehicle to allow communication coverage in an omnidirectional pattern that is also compatible with existing buoyant cable antenna deployment and retrieval systems. The antenna of the present invention comprises a floating cable having four identical antenna elements that are arranged in a cross configuration. The antenna uses the sea surface as a ground plane providing good antenna gain levels. The antenna is designed with an integrated impedance matching network to maximize radiation efficiency.

12 Claims, 4 Drawing Sheets

SCALABLE VERTICAL BUOYANT CABLE ANTENNA

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER RELATED APPLICATIONS

Not applicable.

BACKGROUND OF THE INVENTION (1) Field of the Invention

The present invention relates to antennas for use with an underwater vehicle, and more specifically to a buoyant cable antenna that is towed by a submarine to allow communication coverage in an omni-azimuthal pattern in the Very High Frequency (VHF) frequency bands (30 MHz to 300 MHz) and can also be scaled to cover other frequency bands. This invention is specifically designed to be compatible with existing buoyant cable antenna deployment and retrieval systems.

(2) Description of the Prior Art

Radio frequency communication for submerged underwater vehicles is currently limited to a buoyant cable antenna (BCA) system. Currently, this communication system only provides unidirectional signal coverage, which is of limited utility. The effectiveness of radio frequency communication for underwater vehicles would be greatly increased if omni-azimuthal signal coverage was possible throughout a desired frequency range to limit communication gaps and avoid the necessity of maneuvering an underwater vehicle to establish a good communication link. What is needed is a new and improved buoyant cable antenna that can provide omni-azimuthal signal coverage in a desired frequency range.

SUMMARY OF THE INVENTION

It is a general purpose and object of the present invention to provide omni-azimuthal signal coverage for submerged underwater vehicles through the use of a buoyant cable antenna.

It is a further object to use a matching technique to provide a very high frequency antenna that uses the sea surface as a ground plane with reasonable gain levels above the noise floor.

It is another object of the invention to provide a modular and tunable mechanism to match the impedance of a four element buoyant cable antenna joined to a transmission line of an existing buoyant cable antenna system.

It is another object of the invention to have one vertical component of the buoyant cable antenna perpendicular to the ocean surface at all times.

These objects are accomplished through the use of a modular buoyant cable antenna with a vertical antenna component that eliminates signal null areas. The antenna of the present invention comprises a floating cable having four identical antenna elements that are arranged in a cross configuration where two of the four elements are directly aligned at one hundred eighty degrees in a first spatial plane and the other two elements are directly aligned at one hundred eighty degrees in a second spatial plane parallel to the first spatial plane such that each element is spaced ninety degrees apart from an adjacent element in the parallel spatial plane. The antenna elements are attached to and protrude from the floating cable. While floating on the water surface, the antenna may rotate freely with minimal signal loss with one antenna element always extended above and perpendicular to the water's surface. Omni-azimuthal coverage is achieved by the vertical posture of the antenna elements. The modular buoyant cable antenna of the present invention is specifically designed for compatible use with existing systems onboard underwater vehicles. As such the dimensions of the antenna (particularly the cross-sectional diameter) and the connectors comply with size and connection standards of existing systems. The antenna employs a tunable impedance matching network in a modular chassis to decrease the reflections and increase the radiation properties between the transmission line and the antenna.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
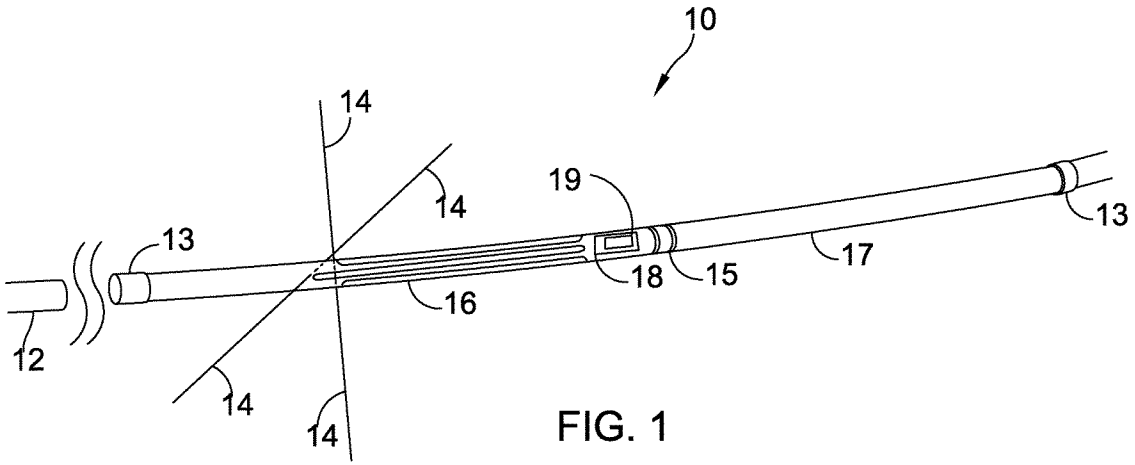
FIG. 1 illustrates the exterior structure of the modular buoyant cable antenna of the present invention.

Referring to FIG. 1, the present invention teaches a modular buoyant cable antenna 10 that is attached to an underwater vehicle via a transmission line 12 and is aligned with an arrangement of existing buoyant cable antenna system components (not shown). The antenna 10 is electrically connected to transmission line 12 through connectors 13 that are compliant with the standards of the existing buoyant cable antenna system. The antenna 10 is towed by a submerged underwater vehicle as the antenna 10 floats on the surface of the water. The antenna 10 is composed of four sections; an encapsulating cylindrical encasement 16, a modular chassis 18 containing a tunable impedance matching network 19, a buoyant section 17 comprising a cable made of polyethylene foam that provides the buoyancy in seawater, and four identical antenna elements 14 that are attached to and protrude from encasement 16.

In a preferred embodiment, encasement 16 is made from a potting compound such as a thermo-setting plastic or a silicone rubber gel that is water tight, flexible, tear resistant and meets the tensile requirements for towing a buoyant cable antenna at specified speeds as well as deployment and retrieval by existing cable antenna systems. In a preferred embodiment the potting compound that comprises encasement 16 is the commercially available PR-1592 manufactured by PPG Aerospace Inc. In a preferred embodiment encasement 16 encapsulates the electronic components (not shown) of the antenna 10. In a preferred embodiment buoyant section 17 is a cable made of polyethylene foam that provides the buoyancy in seawater. Encasement 16 is joined to buoyant section 17 by means of a rubber coupler 15 that allows easier bonding between the potting compound of encasement 16 and the polyethylene of buoyant section 17. In a preferred embodiment the diameter of encasement 16 and buoyant section 17 is 0.65 inch allowing them to conform to the required dimensions of existing cable antenna systems currently in use in underwater vehicles.

Figure 2:
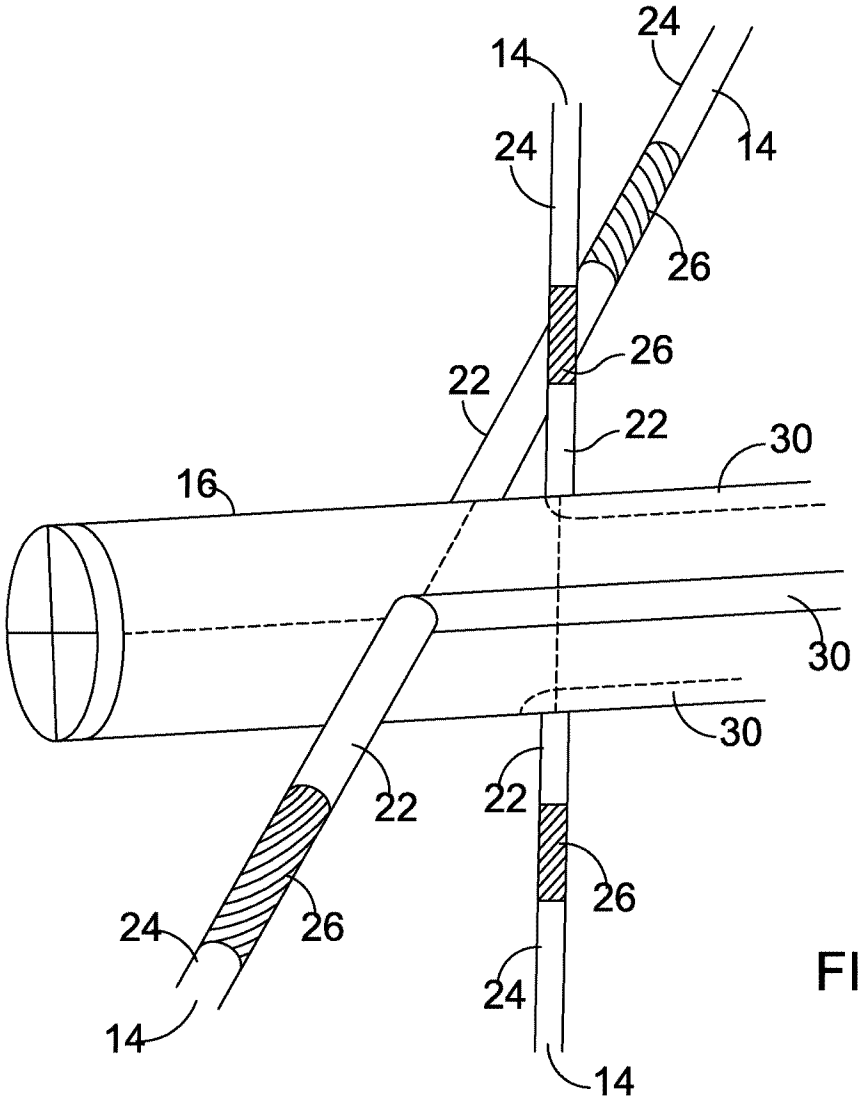
FIG. 2 illustrates the connection of the antenna elements to the encapsulating cylindrical encasement.

Referring to FIG. 2, the antenna elements 14 are held in place by the potting compound of encasement 16. The four identical antenna elements 14 are arranged symmetrically around the encasement 16 in a cross configuration where two elements 14 are directly aligned at one hundred eighty degrees in a first spatial plane and the other two elements are directly aligned at one hundred eighty degrees in a second spatial plane parallel to the first spatial plane such that each element 14 is perpendicular to an adjacent element 14 in the parallel spatial plane. In operation, at least one element 14 is extended vertically above and perpendicular to the water surface when the antenna 10 is deployed regardless of rotations even as the antenna 10 moves along the surface of the water.

Each antenna element 14 is fabricated in sections from different materials. The first section 22 that is attached to the encasement 16 is fabricated using the alloy Nitinol, which has the physical property of high elasticity. The second section 24 is fabricated using carbon fiber, which has the physical properties of rigidity, corrosion resistance and sufficient electrical conductivity as needed for radio frequency communication. In a preferred embodiment the first section 22 protrude one inch from the encasement and the second section 24 is a quarter wave in length at a desired operational frequency plus five extra inches. The two sections 22 and 24 are joined through a mechanical and electrical crimp connection 26. Whereas the carbon fiber increases stiffness for improved towing posture, the Nitinol allows the four antenna elements 14 to bend and fold against the sides of the encasement 16 when the antenna is not deployed. When bent and folded against the encasement 16, the four antenna elements 14 are nested in machined grooves 30 in the encasement 16 such that the overall cross-sectional diameter of the modular section does not exceed the diameter of the encasement 16. In a preferred embodiment, the diameter of the encasement 16 is 0.65 inch allowing it to conform to the required dimensions of existing buoyant cable antenna systems.

Figure 3:
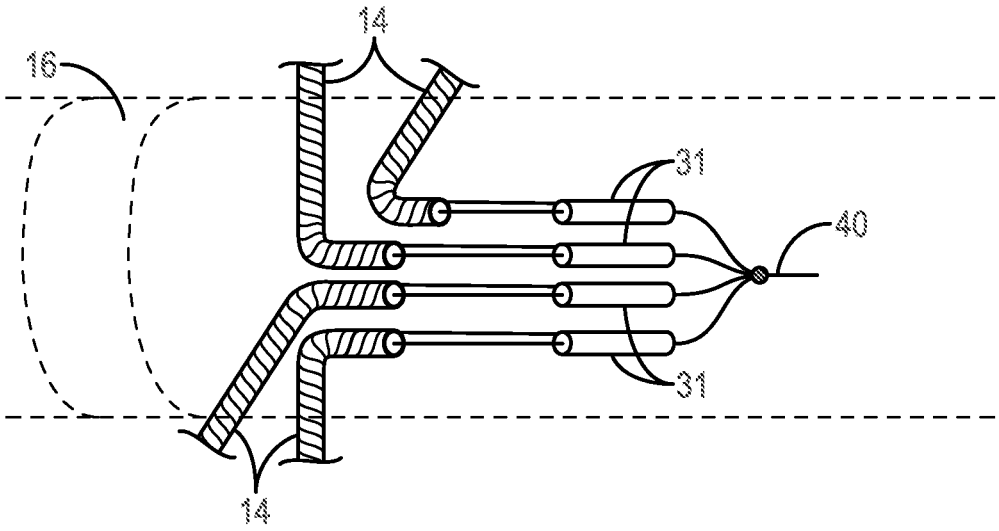
FIG. 3, illustrates the connection configuration of the ends of all four antenna elements electrically connected within the encasement at a single connection point.

Referring to FIG. 3, the ends of all four antenna elements 14 are electrically connected within the encasement 16 at a single connection point 40 through transmission lines 31. The connection configuration is illustrated in FIG. 3. Connecting the elements 14 facilitates impedance matching the antenna, a necessary process to avoid energy reflection, and to promote more efficient antenna radiation.

Figure 4:
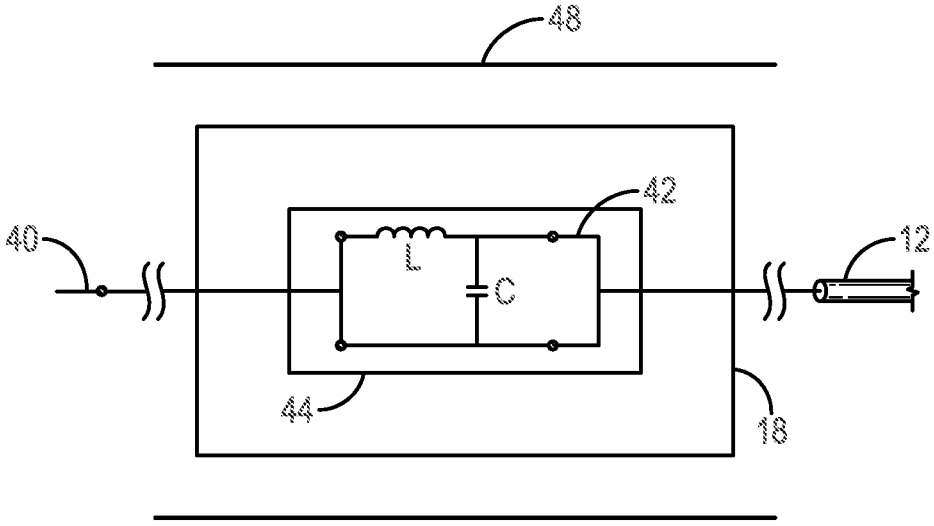
FIG. 4, illustrates the a tunable matching network.

Referring to FIG. 4, there is illustrated an exemplary tunable matching network 42 for impedance matching the antenna 10. The components of the matching network 42 as illustrated represents a single embodiment using a capacitor C and inductor L, however, other embodiments may also be suitable depending on the impedance of the transmission line 12. Matching network 42 is electrically connected to the elements 14 after connection point 40. The implementation of matching network 42 within antenna 10 is intended to match the impedance of the elements 14 with the impedance of the transmission line 12 in order to reduce the reflections between the transmission line 12 and the antenna 10.

Matching network 42 is designed to allow modification/substitution of its internal electrical components in order to tune the antenna 10 to a specific frequency. In a preferred embodiment, the network 42 is designed on a removable circuit board 44 and placed in a modular chassis 18 that is then placed in a water proof housing 48 that is joined to encasement 16 and buoyant section 17.

Figure 5:
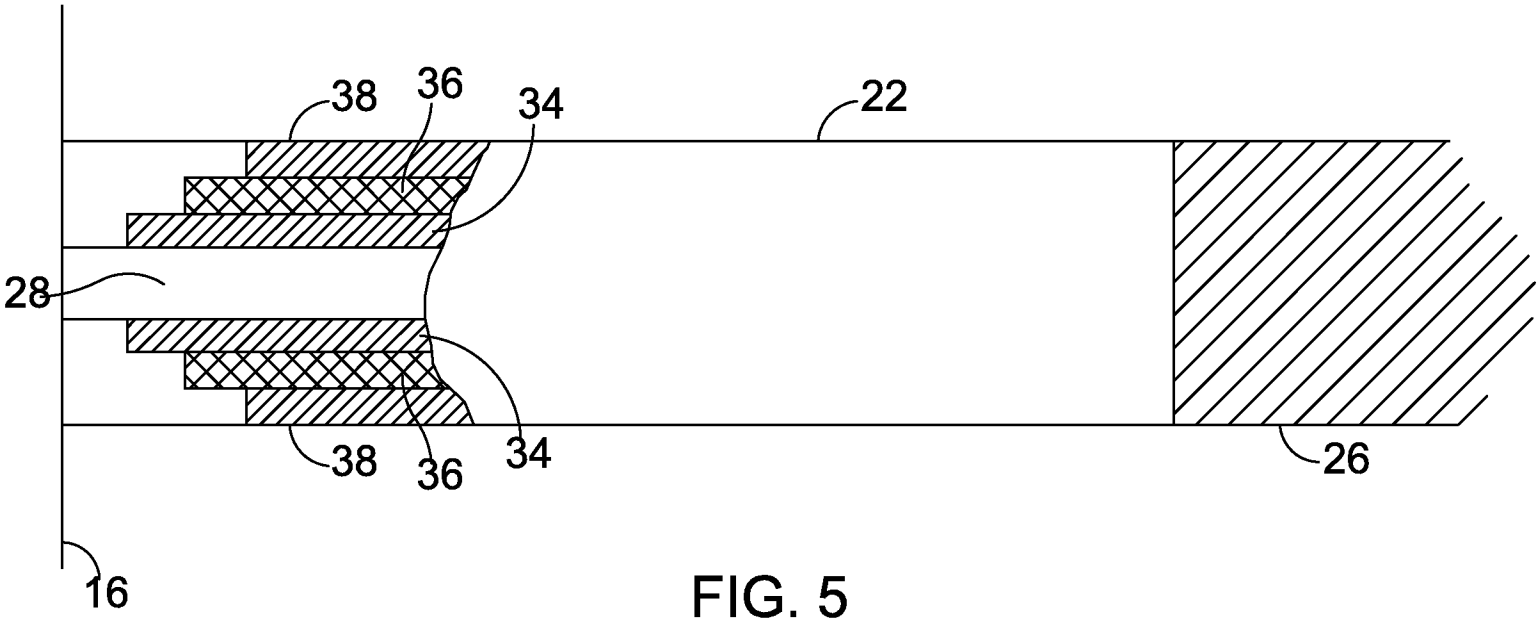
FIG. 5 illustrates the flexible shielded first section of the antenna elements.

As illustrated in FIG. 5, for each antenna element 14, the first section 22 is shielded. In a preferred embodiment the first section 22 is six inches long. The Nitinol 28 is covered by a layer 34 of insulating material. Disposed over the layer 34 of insulating material is a braid 36 of conductive material. The braid 36 is covered by an outer layer 38 of insulating material. The braid 36 is electrically connected to the ground in the antenna system (not shown). The arrangement of layer 34 covered by braid 36 covered by outer layer 38 combines to create a coaxial cable for the first section 22 of each antenna element 14. The coaxial cable design provides shielding to protect the antenna 10 from signal dropout, which can occur when the plane of the sea water rises on the antenna elements of an unshielded antenna.

The advantages of the present invention are that the antenna 10 allows communication coverage in an omni-azimuthal pattern. The modular buoyant cable antenna 10 is compatible with existing buoyant cable antenna systems due to its dimensions and its use of standard connectors. This allows users to quickly add, remove, or interchange the antenna 10 with existing buoyant cable antenna systems. An advantage of the integrated impedance matching network is that even if the antenna elements rotate while the antenna is deployed causing the elements to change position the matching network continues to perform its function so long as one element remains above the water surface. The simplicity of the impedance matching network allows modification of the components in order to tune the antenna to a wide range of frequencies.

In light of the above, it is therefore understood that within the scope of the appended claims, the invention may be practiced otherwise than as specifically described.

What is claimed is:

1. A modular buoyant cable antenna for use with an underwater vehicle comprising:

an encapsulating cylindrical encasement joined to an underwater vehicle via a transmission line, wherein the encasement is made from a potting compound that encapsulates a plurality of electronic components of the antenna;

a buoyant section joined to said encapsulating cylindrical encasement, wherein the buoyant section is a cable made of polyethylene foam that provides buoyancy in seawater;

four identical antenna elements that are attached to and protrude from said encapsulating cylindrical encasement wherein the four identical antenna elements are arranged symmetrically around the encasement in a cross configuration where two elements are directly aligned at one hundred eighty degrees in a first spatial plane and the other two elements are directly aligned at one hundred eighty degrees in a second spatial plane parallel to the first spatial plane such that each element is perpendicular to an adjacent element in the adjacent parallel spatial plane, wherein in operation at least one element is extended vertically above and perpendicular to a water surface when the antenna is deployed regardless of the encasement rotations as the antenna moves along the surface of the water, wherein the four antenna elements are designed to bend and fold against the sides of the encasement when the antenna is not deployed such that when bent and folded against the encasement the four antenna elements are nested in grooves that are molded in the encasement and machined in the buoyant section, such that the overall cross-sectional diameter of the antenna remains constant when the four antenna elements are folded into the grooves, wherein each of the four antenna elements are electrically connected within the encasement to the transmission line at a single connection point;

a tunable impedance matching network for impedance matching the antenna, wherein said matching network is electrically connected to the four antenna elements after the single connection point;

wherein the design and dimensions of the modular buoyant cable antenna allow it to float on the surface of a body of water while being towed by an underwater vehicle to be deployed and retrieved by an existing cable antenna deployment and retrieval system;

wherein each antenna element is fabricated in sections from different materials comprising:

a first section that is attached to the encasement being fabricated from the alloy Nitinol, which has the physical property of high elasticity allowing the four antenna elements to bend and fold against the sides of the encasement when the antenna is not deployed;

a second section being fabricated from carbon fiber, which has the physical property of rigidity for improved towing posture, corrosion resistance and sufficient electrical conductivity as needed for radio frequency communication; and a mechanical and electrical crimp connection that joins the first section to the second section.

2. The antenna of claim 1 wherein for each antenna element the first section fabricated from Nitinol is shielded by an arrangement of layers comprising:

a first layer of insulating material disposed over the first section;

a braid of conductive material disposed over the layer of insulating material, wherein the braid is electrically connected to the ground of the antenna system;

an outer layer of insulating material disposed over the braid of conductive material; and wherein the arrangement of the first layer of insulating material covered by the braid of conductive material covered by the outer layer of insulating material combines to create a coaxial cable for the first section of each antenna element which provides shielding to protect the antenna from signal dropout.

3. The antenna of claim 1 wherein the potting compound is a thermo-setting plastic that is water tight, flexible, tear resistant and meets the tensile requirements for deployment and retrieval of a buoyant cable antenna in an existing cable antenna deployment and retrieval system.

4. The antenna of claim 1 further comprising connectors that are compliant with the standards of existing buoyant cable antenna systems that connect the antenna to the transmission line.

5. The antenna of claim 1 wherein the potting compound that comprises the encapsulating cylindrical encasement is PR-1592 manufactured by PPG Aerospace Inc.

6. The antenna of claim 1 wherein the encapsulating cylindrical encasement is joined to the buoyant section by means of a rubber coupler that allows easier bonding between the potting compound of the encapsulating cylindrical encasement and the polyethylene of the buoyant section.

7. The antenna of claim 1 wherein the diameter of encasement 16 and buoyant section 17 is 0.65 inch allowing them to conform to the required dimensions of an existing cable antenna deployment and retrieval system.

8. The antenna of claim 1 wherein the second section of each of the four antenna elements is a quarter wave in length at a desired operational frequency.

9. The antenna of claim 1 wherein the matching network is joined in series with an antenna circuit, wherein the implementation of the matching network within the antenna matches the impedance of the four antenna elements to reduce the reflections between the transmission line and the antenna, wherein the matching network increases the radiation efficiency of the antenna.

10. The antenna of claim 9 wherein the matching network is fabricated on a removable circuit board designed to allow modification and substitution of its internal electrical components in order to tune the antenna to a specific frequency in a different desired frequency.

11. The antenna of claim 10 further comprising a modular chassis that contains the matching network circuit board; and a water proof housing that surrounds the modular chassis and is joined to the encapsulating cylindrical encasement and buoyant section.

12. The antenna of claim 1 wherein a length of the transmission line is such that the impedance of the four antenna elements together moves along a smith chart to a point that provides matching with a plurality of electrical components.

* * * * *